United States Patent [19]

Kernkamp et al.

[11] Patent Number: 4,602,566

[45] Date of Patent: Jul. 29, 1986

[54] HANDLING APPARATUS FOR SUSPENDED TRANSFER OF CARGOS, I.E. IN PARTICULAR A CRANE FOR LOADING AND UNLOADING CONTAINERS

[75] Inventors: W. J. A. Kernkamp, Delft; M. M. De Jongh, Rotterdam, both of Netherlands

[73] Assignee: Natdevco B.V., Rotterdam, Netherlands

[21] Appl. No.: 635,397

[22] Filed: Jul. 30, 1984

[30] Foreign Application Priority Data

Jul. 29, 1983 [NL] Netherlands ..... 8302716

[51] Int. Cl.[4] ..... B66C 7/12; E01B 25/26

[52] U.S. Cl. ..... 104/91; 104/98; 198/802; 212/210; 212/225

[58] Field of Search ..... 104/89, 91, 96, 98; 198/478, 802; 212/210, 225

[56] References Cited

U.S. PATENT DOCUMENTS

| | | | |
|---|---|---|---|
| 2,747,724 | 5/1956 | Kornylak | 198/802 X |
| 3,543,953 | 12/1970 | Ponsen | 212/210 X |
| 3,881,608 | 5/1975 | Hupkes | 212/210 X |

FOREIGN PATENT DOCUMENTS

| | | |
|---|---|---|
| 662116 | 7/1938 | Fed. Rep. of Germany . |
| 51664 | 7/1941 | Netherlands . |
| 7211277 | 12/1974 | Netherlands . |

*Primary Examiner*—Robert B. Reeves
*Assistant Examiner*—David F. Hubbuch
*Attorney, Agent, or Firm*—Jordan and Hamburg

[57] ABSTRACT

A handling apparatus adapted to be installed on a crane with a boom for loading and unloading materials comprises track device installed on the crane and at least two carrying devices suspended from the track device. The track device includes at least three track sections situated substantially parallel to each other. The track sections are connected to the respective adjacent track sections so that two elongated endless tracks slightly offset in the longitudinal direction thereof are formed. Each carrying device includes a carrier and a pair of crabs situated on the track sections for suspending the carrier under the track device. The crabs are arranged on the carrier so that when the carrier is oriented perpendicular to the track section, the two crabs are located on the track sections remote from each other, and when the carrier is oriented parallel to the track sections, the two crabs are located on the remaining track section.

5 Claims, 4 Drawing Figures

HANDLING APPARATUS FOR SUSPENDED TRANSFER OF CARGOS, I.E. IN PARTICULAR A CRANE FOR LOADING AND UNLOADING CONTAINERS

BACKGROUND OF THE INVENTION

The invention relates to a handling apparatus for suspended transfer of loads, such as in particular to a crane for loading and unloading of containers equipped with a boom including at least two parallel tracks for trolleys, each track consisting in turn of two parallel track sections each with its own travelling crab for each track section of a trolley, the two travelling crabs working in pairs with suspended carriers allowing container handling.

A handling apparatus of this kind is known from the Dutch Patent Application No. 7211277. This design allows for two parallel tracks on different levels each allowing transfer of a load or a container. When the top trolley is operated, the container is lined up with the crane using a swivelling platform, thus allowing the load to be eased through the arms of the lower trolley. Although this arrangement makes it possible to move two trolleys back and forth on the same crane, which is a capacity improvement as related to the single trolley crane, capacity is still limited to one single trolley for each track, while hoisting, maneuvering and lowering of loaded containers with a heavy weight is a time-consuming job which greatly limits the capacity of the top track.

SUMMARY OF THE INVENTION

The purpose of the invention is to remove the aforementioned drawbacks and supply a handling arrangement of the kind related to in the title, thereby increasing capacity by allowing a number of containers to be transferred along a track one behind the other and avoiding hoisting, maneuvering and lowering of heavy containers.

This purpose is achieved in the invention by connecting the track sections in pairs by bends or otherwise thus constituting mainly horizontal endless tracks, which tracks are parallel along the crane but with shifted ends, lengthwise, and where each one trolley has one crab travelling along one and the second crab travelling along the other endless track causing the trolley with the crabs travelling along the farthest removed track sections to shift at a straight angle to the center line of the crane, while the trolley with the crab moving along the inner track sections will be lined up with the crane center line, a shift of direction of the trolleys which is brought about at the bends or end sections of the endless tracks.

Implementation of the invention allows a number of trolleys to participate in a continuous movement one after the other. In this case, trolleys moving at straight angles with the direction of the crane will transfer the loaded containers while the empty ones or the plain return movement will be accomplished along the crane center line thus saving time for lifting and lowering while trolley position will be automatically or smoothly shifted at the bends or end sections.

The invention will now be described further as illustrated on the attached drawings of examples of its implementation.

DETAILED DESCRIPTION OF THE PREFERRED EMBODIMENTS

Figure 1:
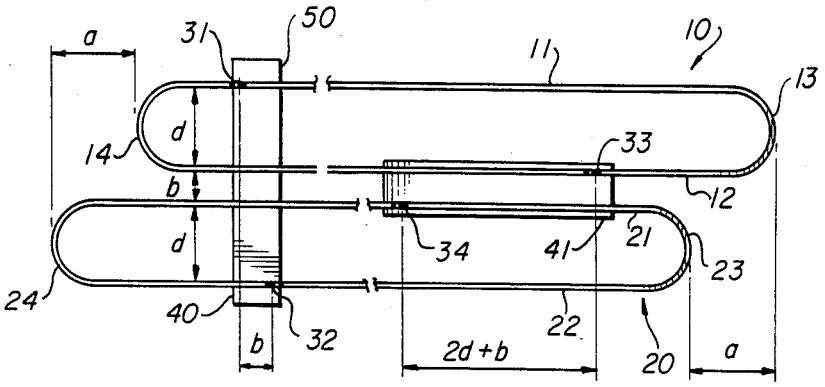
FIG. 1 is a top plan view of the handling apparatus of the invention, wherein a crane with a boom is not shown.

The implementation form represented in the drawing relates to a crane 70 for suspended transfer of heavy loads such as containers. The boom 71 on the crane carries two endless tracks, generally indicated by 10 and 20. Track 10 consists of track sections 11 and 12 running along the center line, at the ends connected by bends 13 and 14. Endless track 20 consists of track sections 21 and 22 running parallel alongside the center line, at the ends connected by bend sections 23 and 24.

The trolleys each consist of two crabs: 31 and 32, 33 and 34 with suspended carriers 40, 41 allowing container or loading crate 50 to be handled. The distance between sections 11 and 12 and between 21 and 22 is equal to value d, while the distance between sections 12 and 21 is equal to value b. The distance between crabs (travelling cats) 31 and 32 is therefore equal to $2d+b$. The distance in the lengthwise direction between crabs 31 and 32 is equal to b.

The longitudinal offset between the two endless tracks 10 and 20 corresponds to a value a. For the achievement of the result illustrated in FIG. 1, it is compulsory that $2d \geqq a \geqq 1.7d$. In this condition, the trolleys will move crosswise along the center line of the handling apparatus with crabs 31 and 32 travelling along sections 11 and 22 while the cross movement is accomplished by crabs 33 and 34 along sections 12 and 21.

In crosswise position, carrier 40 preferably travels with a container or an otherwise heavy load 50, while in longitudinal position, carrier 41 will be preferably empty as it will have to be raised by crab cables 63 and 64 in order to pass between crab cables 61 and 62 connected to crabs 31 and 32 and carrier 40.

The movement of the trolleys with travelling crabs 31 and 32 is opposite to the direction in which the trolleys with crabs 33 and 34 travel. However, if required, the direction can be changed around, e.g. depending on whether the apparatus is used for loading or for unloading.

Figure 2:
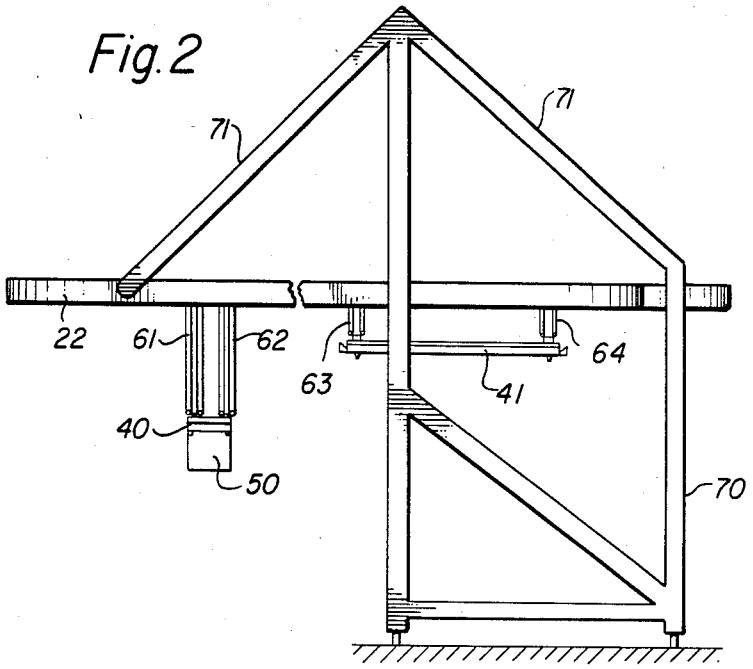
FIG. 2 is a side elevation view of the handling apparatus of the invention.
Figure 3:
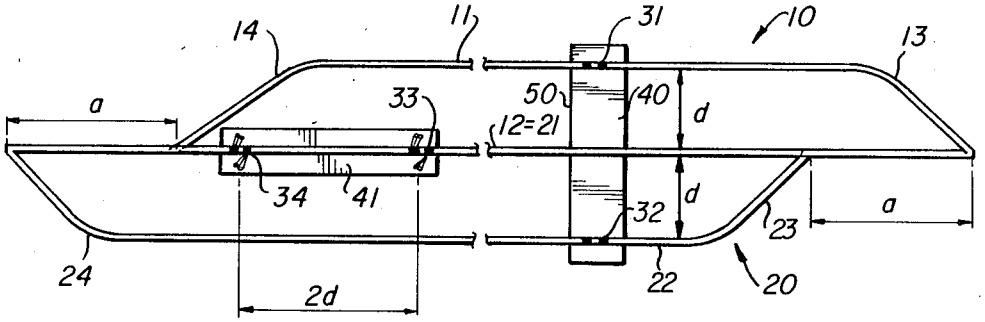
FIG. 3 is a top plan view of another embodiment of the handling apparatus of the invention, wherein a crane with a boom is not shown.
Figure 4:
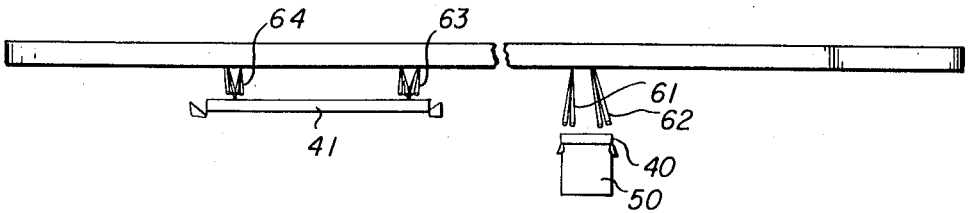
FIG. 4 is a side elevation view corresponding to FIG. 3.

An alternative embodiment is shown in FIGS. 3 and 4 in which the same reference numerals have been used as in FIGS. 1 and 2 to indicate corresponding parts. In the alternative embodiment, the bend sections 13, 14, 23, 24 in FIGS. 1 and 2 are replaced by end sections 13, 24 and shunts 14, 23. The main advantage of the alternative embodiment compared with that of FIGS. 1 and 2 is that trolleys returned without changing orientation after one round. In this way, winding of the cables connected to the carrier is prevented, whereas in the embodiment of FIGS. 1 and 2, special arrangements have to be made for this purpose.

The invention is not limited to the implementation forms illustrated and described, but applies to all variations thereof.

What we claim is:

1. A handling apparatus adapted to be installed on a crane with a boom for loading and unloading materials, comprising:

track means adapted to be installed on the crane and including at least three track sections situated substantially parallel to each other, each said track section being connected to at least one respective adjacent track section so that two elongated endless tracks slightly offset in the longitudinal direction thereof are formed, and at least two carrying means suspended from the track means, each carrying means including a carrier and a pair of crabs situated on the track sections for suspending the carrier under the track means, said crabs being arranged on the carrier so that when the carrier is oriented perpendicular to the track sections, the two crabs are located on the two track sections remote from each other, and when the carrier is oriented parallel to the track sections, the two crabs are located on the at least one remaining track section.

2. A handling apparatus according to claim 1, in which each said carrying means further includes cables situated between each crab and a respective carrier for raising and lowering the carrier so that when the carrier is oriented perpendicular to the track sections, the carrier is located away from the track sections, and when the carrier is oriented parallel to the track sections, the carrier is located close to the track sections to allow the carrier situated perpendicular to the track sections to pass therebelow.

3. A handling apparatus according to claim 2, in which said track means further includes end portions for connecting the track sections to the adjacent track sections.

4. A handling apparatus according to claim 3, in which said track means comprises four track sections situated parallel to each other for forming two separated elongated endless tracks, each of said endless tracks being offset relative to the other in the longitudinal direction thereof.

5. A handling apparatus according to claim 4, in which the offset of said endless tracks in the longitudinal direction is at a value a, wherein $2d \geqq a \geqq 1.7d$, d being the distance between the adjacent track sections forming the respective endless tracks.

* * * * *